US007474726B2

(12) United States Patent
Hempy et al.

(10) Patent No.: US 7,474,726 B2
(45) Date of Patent: Jan. 6, 2009

(54) UNIRRADIATED NUCLEAR FUEL COMPONENT TRANSPORT SYSTEM

(75) Inventors: Brian E. Hempy, Columbia, SC (US); John Dexter Malloy, III, Goode, VA (US); Richard Forsythe Rochow, Forest, VA (US)

(73) Assignee: Westinghouse Electric Co LLC, Pittsburgh, PA (US)

( * ) Notice: Subject to any disclaimer, the term of this patent is extended or adjusted under 35 U.S.C. 154(b) by 0 days.

(21) Appl. No.: 11/678,640

(22) Filed: Feb. 26, 2007

(65) Prior Publication Data

US 2008/0203327 A1 Aug. 28, 2008

(51) Int. Cl.
*G21C 19/06* (2006.01)
*G21F 5/00* (2006.01)

(52) U.S. Cl. ..... 376/272; 250/506.1; 250/507.1

(58) Field of Classification Search ..... 376/272; 250/506.1, 507.1; 220/323, 324, 327, 788; 206/1.5; 70/41, 44, 49, 57, 63, 103, 105, 70/121, 158, 159; 292/32, 40, 161, 192, 292/198, 203, 216, 341.14, 341.17
See application file for complete search history.

(56) References Cited

U.S. PATENT DOCUMENTS

| | | | | |
|---|---|---|---|---|
| 1,799,905 | A * | 4/1931 | Jacobs | 220/263 |
| 3,659,778 | A * | 5/1972 | Saultz et al. | 232/43.1 |
| 4,428,153 | A * | 1/1984 | Klinger et al. | 49/366 |
| 5,265,309 | A * | 11/1993 | Oille | 16/262 |
| 6,108,392 | A * | 8/2000 | Yoshizawa et al. | 376/272 |
| 6,683,931 | B1 | 1/2004 | Stilwell, III et al. | |
| 6,748,042 | B1 * | 6/2004 | Stilwell et al. | 376/272 |
| 2003/0122304 | A1 * | 7/2003 | Santini | 273/292 |

* cited by examiner

*Primary Examiner*—Rick Palabrica
*Assistant Examiner*—Erin M Boyd

(57) ABSTRACT

An unirradiated nuclear fuel assembly component transport system that includes a clamshell-type inner liner that opens either along its axial dimension or from the top to load and unload the fuel assembly being transported. The exterior dimensions of the liner conform to a generic overpack tubular container that protects the liner from impact loads and fires.

15 Claims, 8 Drawing Sheets

UNIRRADIATED NUCLEAR FUEL COMPONENT TRANSPORT SYSTEM

BACKGROUND OF THE INVENTION

1. Field of the Invention

This invention relates to a shipping container for nuclear fuel components and, in particular, to such a container for unirradiated nuclear fuel assemblies and nuclear fuel rods.

2. Related Art

In the shipping and storage of unirradiated nuclear fuel elements and assemblies which contain large quantities and/or enrichments of fissile material, $U^{235}$, it is necessary to assure that criticality is avoided during normal use, as well as under potential accident conditions. For example, nuclear reactor fuel shipping containers are licensed by the Nuclear Regulatory Commission (NRC) to ship specific maximum fuel enrichments; i.e., weights and weight-percent $U^{235}$, for each fuel assembly design. In order for a new shipping container design to receive licensing approval, it must be demonstrated to the satisfaction of the NRC that the new container design will meet the requirements of the NRC rules and regulations, including those defined in 10 CFR § 71. These requirements define the maximum credible accident (MCA) that the shipping container and its internal support structures must endure in order to maintain the sub-criticality of the fuel assembly housed therein.

U.S. Pat. No. 4,780,268, which is assigned to the assignee of the present invention, discloses a shipping container for transporting two conventional nuclear fuel assemblies having a square top nozzle, a square array of fuel rods and a square bottom nozzle. The container includes a support frame having a vertically extending section between the two fuel assemblies which sit side by side. Each fuel assembly is clamped to the support frame by clamping frames which each have two pressure pads. This entire assembly is connected to the container by a shock mounting frame and a plurality of shock mountings. Sealed within the vertical section are at least two neutron absorber elements. A layer of rubber cork cushioning material separates the support frame and the vertical section from the fuel assemblies.

The top nozzle of each of the conventional fuel assemblies is held along the longitudinal axis thereof by jack posts with pressure pads that are tightened down to the square top nozzle at four places. The bottom nozzle of some of these conventional fuel assemblies has a chamfered end. These fuel assemblies are held along the longitudinal access thereof by a bottom nozzle spacer which holds the chamfered end of the bottom nozzle.

These, and other shipping containers, e.g., RCC-4, for generally square cross-sectional geometry pressurized water reactor (PWR) fuel assemblies used by the assignee of the present invention, are described in Certificate of Compliance Number 5454, U.S. Nuclear Regulatory Commission, Division of Fuel Cycle and Material Safety, Office of the Nuclear Material Safety and Safeguards, Washington, D.C. 20555.

U.S. Pat. No. 5,490,186, assigned to the assignee of the present invention, describes a completely different nuclear fuel shipping container designed for hexagonal fuel, and more particularly, for a fuel assembly design for a Soviet-style VVER reactor. Still, other shipping container configurations are required for boiling water reactor fuel.

There is a need, therefore, for an improved shipping container for a nuclear fuel assembly that can be employed interchangeably with a number of nuclear reactor fuel assembly designs.

There is a further need for such a fuel assembly shipping container that can accommodate a single assembly in a lightweight, durable and licensable design.

These and other needs have been partially resolved by U.S. Pat. No. 6,683,931, issued Jan. 27, 2004 and assigned to the assignee of the instant invention. The shipping container described in this latter patent includes an elongated inner tubular liner having an axial dimension at least as long as a fuel assembly. The liner is preferably split in half along its axial dimension so that it can be separated like a clamshell for placement of the two halves of the liner around the fuel assembly. The external circumference of the liner is designed to be closely received within the interior of an overpack formed from an elongated tubular container having an axial dimension at least as long as the liner. Preferably, the walls of the tubular container are constructed from relatively thin shells of stainless steel and the liner is coaxially positioned within the tubular container with close-cell polyurethane disposed in between. Desirably, the inner shell includes boron impregnated stainless steel. The tubular liner enclosing the fuel assembly is slidably mounted within the overpack and the overpack is sealed at each end with end caps. The overpack preferably includes circumferential ribs that extend around the circumference of the tubular container at spaced axial locations that enhance the circumferential rigidity of the overpack and form an attachment point for peripheral shock-absorbing members. An elongated frame, preferably of a birdcage design, is sized to receive the overpack within the external frame in spaced relationship with the frame. The frame is formed from axially spaced circumferential straps that are connected to circumferentially-spaced, axially-oriented support ribs that fixedly connect the straps to form the frame design. A plurality of shock absorbers are connected between certain of the straps and at least two of the circumferential ribs extending around the overpack, to isolate the tubular container from a substantial amount of any impact energy experienced by the frame, should the frame be impacted.

Although the shipping container described in the aforementioned '931 patent is a substantial improvement in that it can accommodate different fuel assembly designs through the use of complementary liners while employing the same overpack and birdcage frame, that improvement has been taken one step further by U.S. Pat. No. 6,748,042, assigned to the assignee of the instant invention. The '042 patent describes a transport system that provides a liner and overpack system that will achieve the same objectives as the '931 patent while further improving the protective characteristics of the transport system and the ease of loading and unloading the nuclear fuel components transported therein. The shipping container includes an elongated tubular container, shell or liner designed to receive and support a nuclear fuel product such as a fuel assembly therein. The interior of the tubular liner preferably conforms to the external envelope of the fuel assembly. The exterior of the tubular container has at least two substantially abutting flat walls which extend axially. In the preferred embodiment, the cross-section of the tubular member is rectangular or hexagonal to match the outer envelope of the fuel assembly and three of the corner seams are hinged so that removal of all the kingpins along a seam will enable two of the sidewalls to swing open and provide access to the interior of the tubular container. The tubular container or liner is designed to seat within an overpack for transport. The overpack is a tubular package having an axial dimension and cross-section larger than the tubular liner. The overpack is split into a plurality of circumferential sections (for example, two sections, a lower support section and an upper cover, or three sections, a lower support section and two upper cover sections) that are respectively hinged to either circumferential side of the lower support section and joined together when the overpack is closed. The lower support section includes an internal central V-shaped groove that extends substantially over the axial length of the overpack a distance at least equal to the axial length of the tubular liner. Shock mounts extend from both radial walls of the V-shaped groove to an elevation that will support the tubular liner in spaced relationship to the groove. The axial location, number, size and type of shock mount employed is changeable to accommodate different loadings. The tubular liner is seated on the shock mounts, preferably with a corner of the liner aligned above the bottom of the V-shaped groove. The top cover section (sections) of the overpack has a complementary inverted V-shaped channel that is sized to accommodate the remainder of the tubular liner with some nominal clearance approximately equal to the spacing between the lower corner of the tubular liner and the bottom of the V-shaped groove. The ends of the overpack are capped and the overpack sections are latched.

Though the transport system of the '042 patent provides a substantial improvement in the protective characteristics and ease of loading and unloading of the nuclear fuel components being transported, further improvement in the ease of loading and unloading the liner is desired.

SUMMARY OF THE INVENTION

This invention provides an improved liner that facilitates the loading and unloading of nuclear components, especially components having hexagonal contour such as the VVER nuclear fuel assemblies. The liner comprises an elongated tubular container designed to receive and support the nuclear fuel product or components therein. An exterior of the tubular container has at least two substantially flat walls with at least one circumferential end of at least one of the walls having a hinged interface with a stationary wall of the container to provide access to the interior thereof. The hinged wall extends axially in the direction of one end of the container and terminates a pre-selected distance short of the corresponding end of the stationary wall. The stationary wall has a lateral groove on an interior surface thereof at an elevations starting substantially at the elevation of the one end of the hinged wall. An access cover is slidable in the groove in the stationary wall to close off the one end of the container so that the interior of the container may be accessed either through the one end by sliding out the access cover, or from the side by rotating the hinged wall. The elongated tubular container has the other end opposite the one end capped and sealed and is sized to fit within the overpack of the '042 patent.

Preferably, a mechanism is provided for locking the access cover in a closed position when the container is prepared for transport. Desirably, the locking mechanism is a pair of radially extending arms that pivot proximate one end on each of the radially extending arms that faces towards the center of the access cover. The pivot enables the radially extending arms to rotate from a position orthogonal to the axis of the elongated tubular container toward the axis. Each of the radially extending arms extends at a distal end into a slot in the stationary wall that extends axially to the one end of the stationary wall so that when the radially extending arms are rotated into a horizontal position and engage the slot in the stationary wall, the access cover cannot slide in the groove. In this preferred embodiment, the radially extending arms are laterally restrained in a slot in an outwardly projecting face of the access cover. Preferably, the outwardly-projecting face of the access cover is formed from a raised fork having two spaced prongs of a given width that form the walls of the slot in the outwardly-projecting face of the access cover. A hole is formed in the width of the wall of each prong that is aligned with a hole in the corresponding radially extending arm when the radially extending arm is rotated in the horizontal position to engage the slot in the outwardly-projecting face of the access cover. Thus, when a pin is inserted through the holes when the radially extending arm is in the horizontal position, the radially extending arm is locked in engagement with the slot in the stationary wall.

Preferably, the liner has at least two hinged walls that interface at their non-hinged circumferential ends in a closed position. One of the non-hinged circumferential ends of the hinged wall has an axially extending tongue and the other of the non-hinged circumferential ends of the hinged wall has an axially extending groove that mates with the tongue when the two hinged walls are in the closed position. Preferably, the stationary and hinged walls of the liner are constructed from three extruded sections.

In another embodiment, the access cover has an axially-extending lip extending in the direction of the hinged door. The lip of the access cover extends over an outer surface of the hinged door at the one end when the access cover is fully seated in the groove. Thus, when the access cover is fully seated to close off the one end of the tubular liner, it prevents the hinged door from rotating toward an open position.

In still another embodiment, the access cover includes a hold-down plate supported on an underside of the cover. The hold-down plate is adjustable in the axial direction to bring pressure on the nuclear product being transport to secure the nuclear product against a bottom member of the elongated tubular liner. Preferably, in the withdrawn position, the hold-down plate is secured within a recess in the access cover.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENTS

Figure 1:
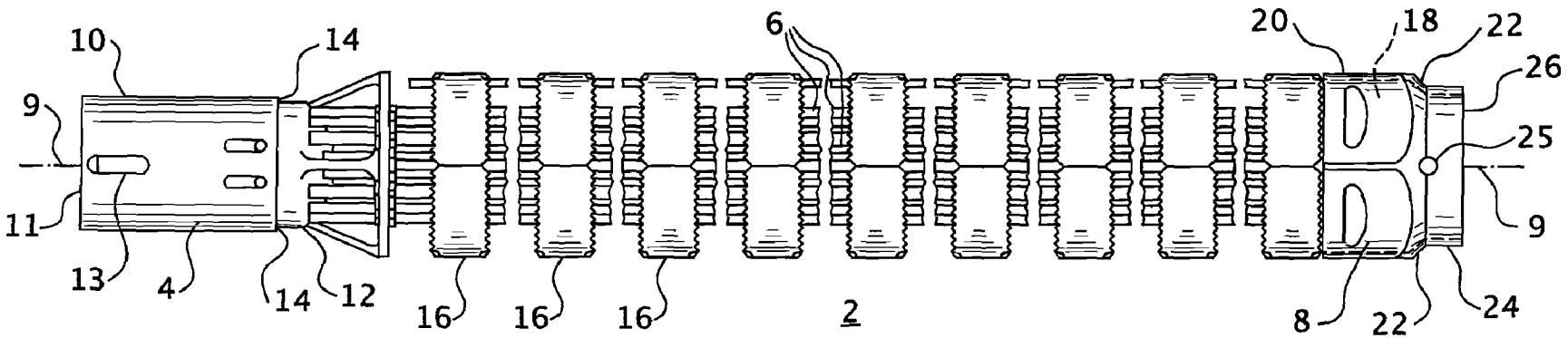
FIG. 1 Prior Art
FIG. 1 is a side view of a nuclear fuel assembly having a top nozzle, a hexagonal array of fuel rods, and a bottom nozzle.

In the preferred embodiment, this invention provides a transport system for transporting nuclear fuel assemblies and particularly, nuclear fuel assemblies having a hexagonal profile such as those employed in the VVER nuclear reactors. An exemplary VVER 1000 nuclear fuel assembly 2 manufactured by Westinghouse Electric Company LLC, which is the assignee of the present invention, is shown in FIG. 1. The fuel assembly 2 includes a top nozzle 4, a hexagonal array of a plurality of fuel rods 6 and a bottom nozzle 8. The top nozzle 4, the fuel rods 6 and the bottom nozzle 8 are positioned about a central longitudinal axis 9 of the fuel assembly 2. The top nozzle 4 includes a cylindrical outer barrel 10 having a top end 11 and two lifting lugs 13 (only one is shown), a cylindrical inner barrel 12 which telescopes into the outer barrel 10, and a shoulder 14 between the outer barrel 10 and the inner barrel 12. The fuel rods 6 are held in the hexagonal array by a plurality of hexagonal grids 16 spaced longitudinally along the fuel rods 6. The exemplary fuel assembly 2 includes 9 hexagonal grids 16. Each of the grids 16 has six sides.

Figure 2:
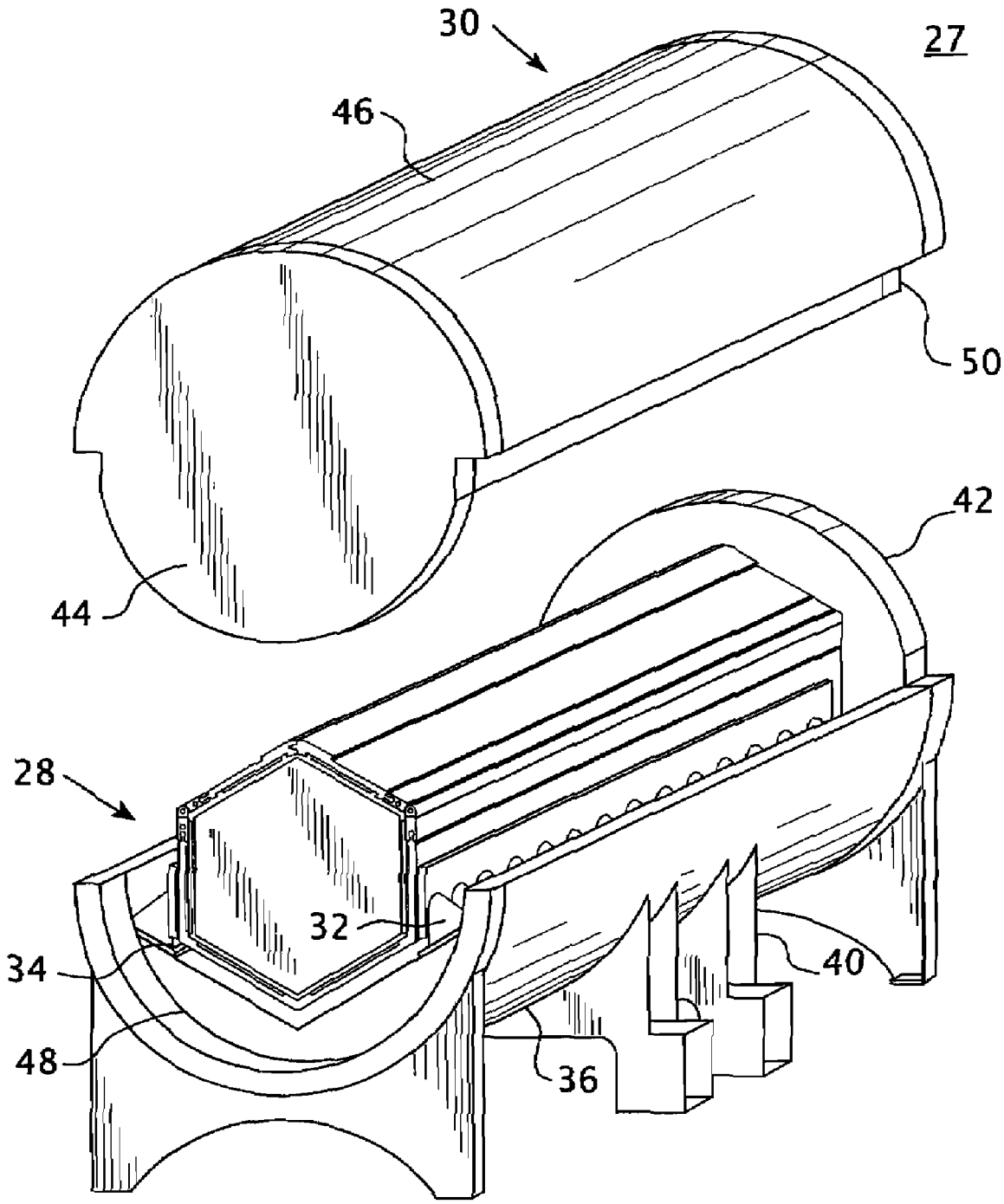
FIG. 2 is a front view of the shipping container system of this invention, showing neutron moderated material lining the inner channel of the overpack.

The bottom nozzle 8 includes a longitudinally-extending recess 18 formed by a hexagonal barrel 20, a spherical taper 22, and a cylindrical barrel 24 which has a diameter smaller than the hexagonal barrel 20. Disposed on the cylindrical barrel 24 are two alignment pins 25 (only one is shown). The spherical taper 22 interconnects the hexagonal barrel 20 and the cylindrical barrel 24 which forms a bottom end 26 of the fuel assembly 2. The longitudinally-extending recess 18 tapers towards the bottom end 26 and also forms an internal shoulder between the hexagonal barrel 20 and the bottom end 26. The fuel assembly 2 will be secured within a liner 28 which will be described hereafter with respect to FIGS. 3, 5, 6, 7, 8 and 9. The liner 28 will, in turn, be secured within an overpack 30 which is intended to protect the fuel assembly 2 from impacts and fires. The overpack 30 and the internal components of the nuclear fuel product containment and transport system of this invention is illustrated in FIG. 2. A tubular liner, sometimes referred to as container or shell 28, constructed from a material such as aluminum, houses the nuclear fuel assembly 2. The tubular liner 28 is suspended over a V-shaped groove 32 in the overpack 30 and supported on shock mounts 32 that are affixed in a recess 34 in an upper wall section of the groove 32 and spaced along the axial length of the lower overpack support section 36. The shock mounts can be those identified by part number J-3424-21, which can be purchased from Lord Corporation, having offices in Cambridge Springs, Pa. Angle irons 24 can be used at the corners of the tubular liner 28 to spread the load on the liner walls. The number and resiliency of the shock mounts are chosen to match the weight of the liner, which depends upon the nuclear product being transported within the liner 28. The orientation of the lower section 36 of the overpack 30 is fixed by the legs 40 so that the weight of the liner 28 holds the liner centered in the groove 32. One capped end 42 of the overpack 30 forms part of the lower overpack support section 36, while a second capped end 44 is formed as an integral part of the top cover 46. The end 44 of the upper overpack segment 46 seals against the lip 48 in the lower support section 36. Keys 50 on each side of the upper section 46 of the overpack 30 fit in complementary keyways in the lower overpack support section 36, as can be better appreciated from the frontal view shown in FIG. 3.

Figure 3:
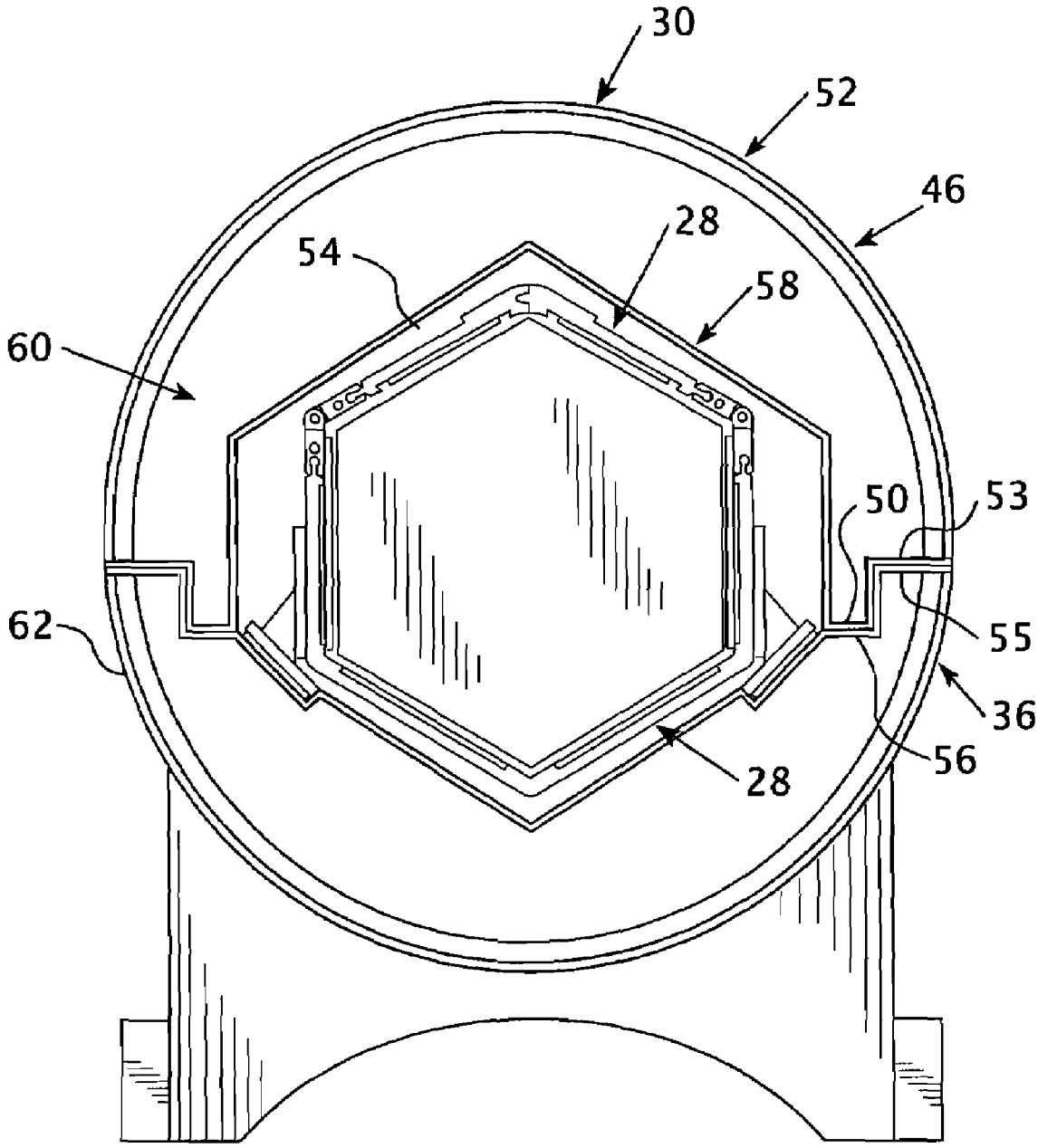
FIG. 3 is a front view of the shipping container system of this invention with thermal insulation lining the interior of the stainless steel shell and neutron-absorbing material lining the exterior of the tubular container surrounding a fuel assembly.

FIG. 3 shows a frontal view of the shipping container system 27 of this invention with the end plate 44 removed. Both the top segment 46 and the bottom segment 36 of the overpack 30 are formed from hollow stainless steel sheet 52. For example, an 11 gauge stainless steel shell filled with polyurethane can be employed. Preferably, in this embodiment, the polyurethane has a minimum 3" (7.62 cm) thickness. In the preferred embodiment, the hollow channel in the overpack 54 is shaped to substantially conform to the outer profile of the tubular liner 28 and the walls of the hollow channel 54 can be lined with a neutron-absorbing material, such as a half-inch (1.27 cm) of borosilicate. Alternately, the outer surface of the tubular liner 28 can be lined with a neutron-absorbable material, such as a ⅛" (0.318 cm) thick layer of borosilicate, or a combination of neutron-absorbing material on the walls of the tubular liner 28 and the walls of the hollow channel 54 can be employed. FIG. 3 provides a better view of the recess 34 that the shock mounts 32 are mounted in than can be derived from FIG. 2. Similarly, the keys 50 and keyways 56 that aid in positioning the top section 46 on the lower support section 36 of the overpack 30 are shown more clearly in FIG. 3. The top and bottom overpack sections 46 and 36, respectively, are formed from a stainless steel shell 58 that is filled with polyurethane 60. Thermal insulation 62 can be incorporated to line the interior of the stainless steel sheet overpack shell 52.

Figure 4:
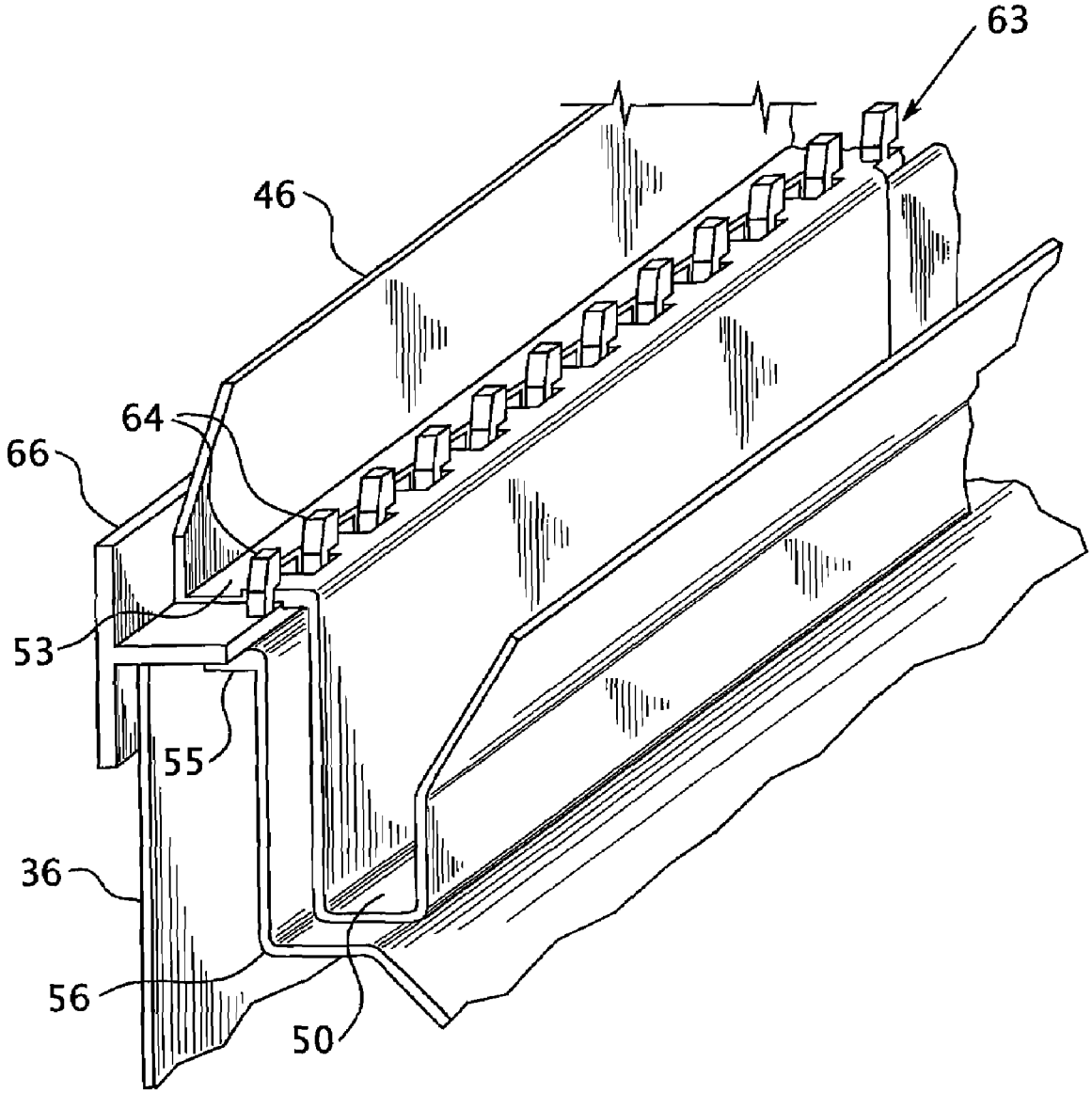
FIG. 4 is a perspective view of the latch mechanism used to anchor the overpack segments together.

The top segment 46 of the overpack is latched to the bottom support segment 36 in the preferred embodiment using the latch assembly shown in FIG. 4. Both the lip 53 on the upper overpack section 46 and the lip 55 on the lower overpack section 36 include a plurality of axially-spaced slots. A latchbar 66 is affixed to either the upper lip 53 or the lower lip 55 in a manner to permit the clamp arm 64 to slide within a corresponding slot in the lip. For example, with the latchbar 66 coupled to the lower lip 55, the clamp arm 64 would protrude through the corresponding slot in a downward direction and have a large protruding end to anchor the latchbar 66 to the lower lip 55. The upper clamp arm 64 can have an L-shape, as shown in FIG. 4, so that when the lip 53 is seated over its corresponding clamp arm 64, the latchbar 66 can be moved in a direction into the Figure to lock the upper section 46 to the lower section 36 of the overpack 30. The clamp arm 64 can then be secured in that locked position and an external lever can be used to slide the latchbar 66 to an open and closed position with an approximate 4" stroke desirable. To facilitate the locking and unlocking action, a low-friction coating can be applied to the sliding surfaces.

Figure 5:
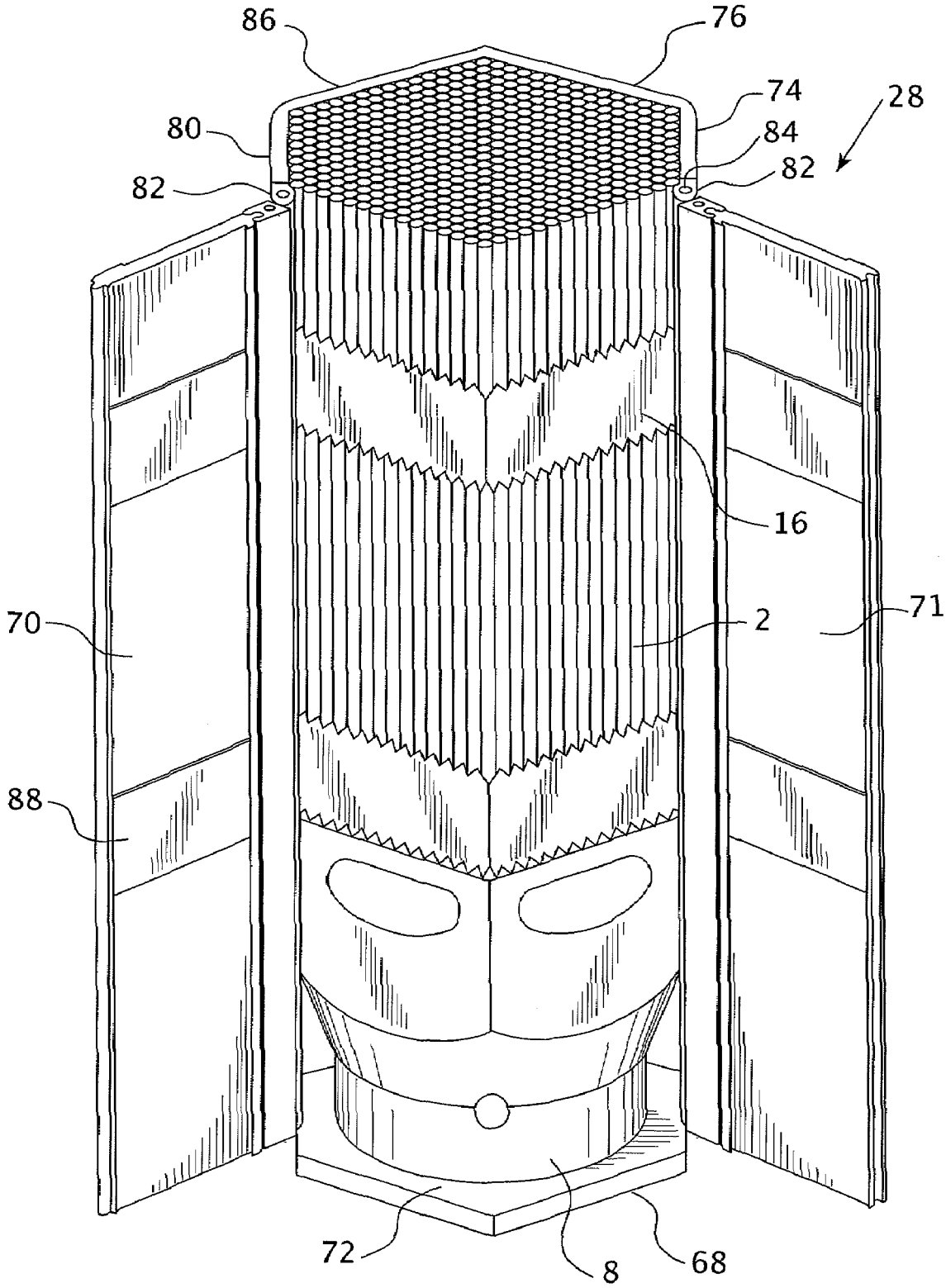
FIG. 5 is a perspective view of the tubular container housing a nuclear fuel assembly with two sides of the tubular container swung open.

FIG. 5 illustrates a perspective view of an open tubular liner 28 with a fuel assembly 2 positioned therein. As previously mentioned with respect to FIG. 1, the fuel assembly 2 is made up of a parallel spaced array of fuel elements 6 that are maintained in spaced relationship and in position by grid straps 16, bottom nozzle 8 and a top nozzle which is not shown. The grid straps are constructed in an egg crate design to maintain the spacing between the fuel elements 6 that form flow channels for the reactor coolant to flow through during reactor operation. The fuel assembly 2 is seated on a neoprene or cork rubber bottom pad 72 which is affixed to the bottom 68 of the tubular liner 28. The neoprene or cork rubber pad 72 supports and cushions the fuel assembly 2. A similar arrangement is provided above the fuel assembly 2 by a neoprene or cork rubber hold down plate that is supported by a top access cover to the tubular liner 28 as will be more fully described with regard to FIG. 8. In this embodiment, the tubular container has four stationary sides, 74, 76, 78 and 80 (shown in FIG. 6) which are affixed to the bottom 68 of the tubular liner 28. The tubular liner 28 has two movable sides 70 and 71 which are hinged to the adjacent edges of the stationary sides 74 and 78 through hinges 82 that rotate around a kingpin 84. The two movable sides are in turn connected, when latched, by similar hinges 82, with the insertion of the kingpin in the hinge forming the latch. In this way, the movable sides 70 and 71 can be opened from any of the hinged seams to provide access to the interior of the tubular liner 26 from a number of different directions to facilitate loading and unloading in different environments that may present obstructions. For quick access, the hinges connecting a given side may be connected by a single kingpin that extends through the lower hinge and up through each of the individual hinges 82 extending up the hinged seam. The tubular liner 28 is preferably constructed out of aluminum of a thickness, for example, of 0.375" (0.9525 cm).

Figure 6:
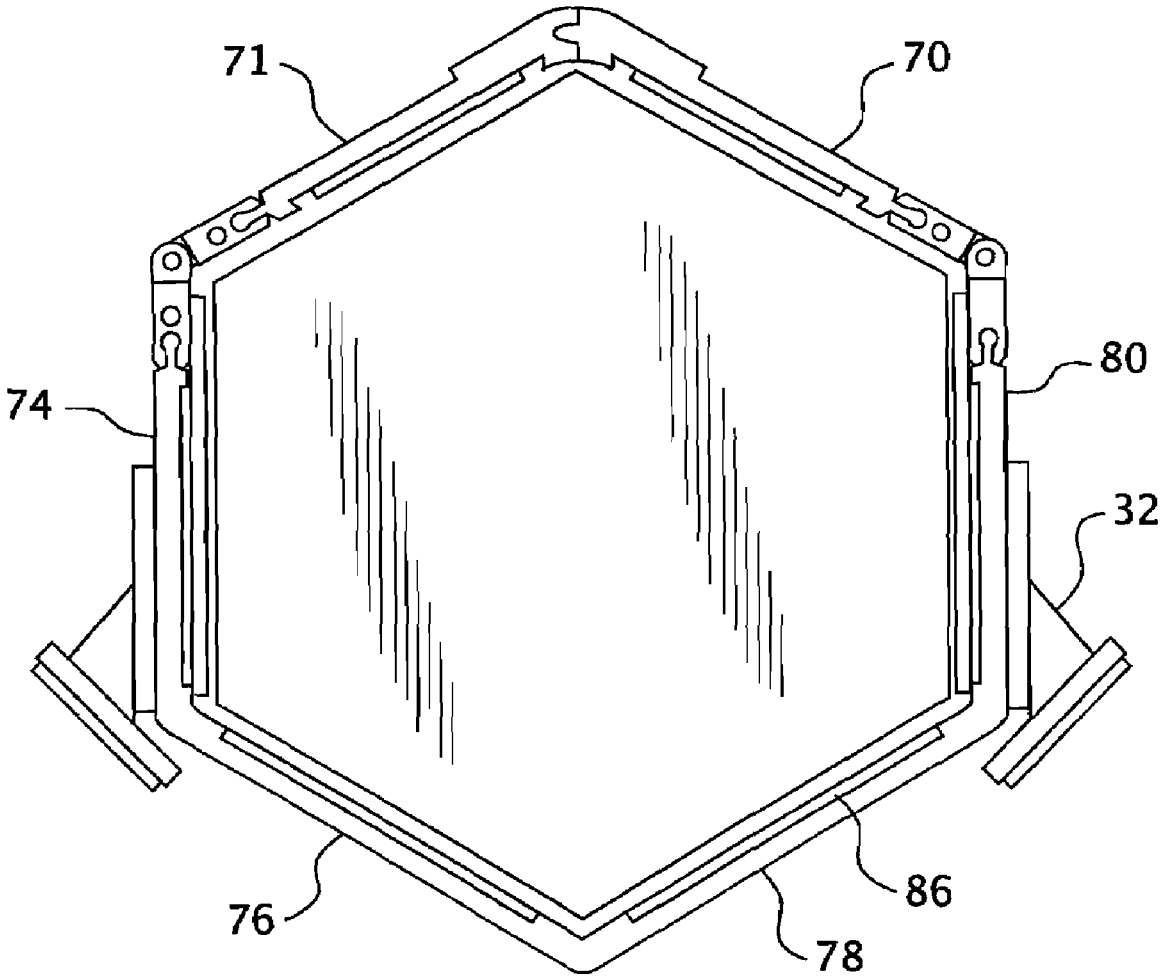
FIG. 6 is a top view of the tubular container having two hinged walls with all six sidewalls closed.

The interior walls of the sides 70, 71, 74, 76, 78 and 80 are covered with an iron ferrite composite sheet 86 and neoprene or cork rubber pads with magnetic backing 88 attached and affixed by the magnetic force at the grid elevations to seat the neoprene or cork rubber side of the pads against the outside straps of the grids 16. The magnetic coupling on the pads make them adjustable to accommodate different nuclear fuel component designs. The neoprene or cork rubber pads are not as hard as the material that the grids are constructed of and secures the grids in position when the movable sides 70 and 71 are in the closed position, without damaging the grids, and cushions the fuel assembly 2 during transport. The inside of the tubular liner 28 can be used to transport other fuel components, such as fuel rods, separately by employing inserts within the tubular container 28 that will hold those components securely. Alternatively, clips on the backs of the neoprene or cork rubber pads can be supported in slots at multiple elevations on the interior walls of the sides 70, 71, 74, 76, 78 and 80. Axial adjustment of the pads can be made by moving the pads from slot to slot. FIG. 6 provides a better view of the iron ferrite composite sheet 86 and hinged locations. FIG. 6 shows the bottom 68 of the tubular line 28 supported on the shock mounts 32 within the overpack 30. From FIG. 6, it can be appreciated that one of the opening edges of the movable walls 70 and 71 has a groove that extends axially down its entire length while the other of the edges of the movable walls 70 and 71 has an axially extending tongue that mates with the groove when the movable walls 70 and 71 are in the closed position, as shown in FIG. 6. Though the preferred embodiment is shown with a hexagonal liner compatible with VVER 1000 fuel, it should be appreciated that the novel features of this invention can be applied equally as well to a square reactor fuel assembly such as those employed in Westinghouse Electric Company LLC designed reactors. This invention has particular benefit for handling hexagonal fuel because it provides additional choices for access to the interior of the liner for loading the hexagonal fuel which can present handling difficulties that are not encountered with square fuel configurations.

Figure 7:
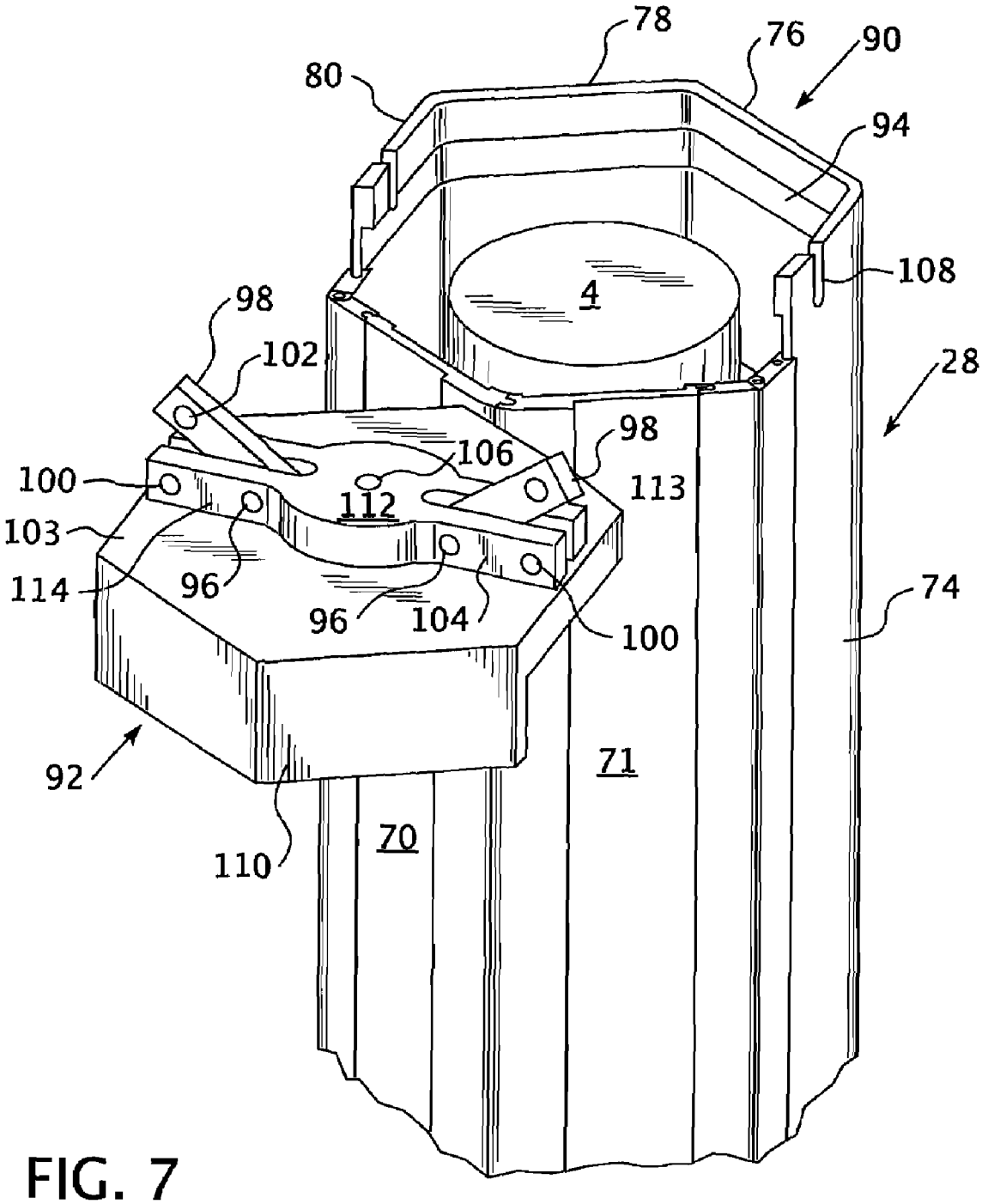
FIG. 7 is a perspective view of the top end of the tubular liner of this invention showing the access cover removed.

FIG. 7 shows the top 90 of the liner 28 with an access cover 92 in the open position. With the access cover 92 removed from the top of the tubular liner 28, as shown in FIG. 7, the fuel assembly 2 may be loaded into the liner from the top of the liner as an alternative to being loaded from the side through the movable sides 70 and 71. To close the liner 28, the access cover 92 slides within a circumferential groove 94 in the stationary walls 74, 76, 78 and 80. The access cover 92, on its upper surface 103, has diametrically opposed raised forks 104 that are connected by a central hub 112. The tines 114 of the forks 104 define a groove 113 within which radially extending arms 98 are laterally restrained and pivot about pivot points 96. When the access cover 92 is in the closed position seated within the grooves 94, the radially extending arms 98 can be rotated about the pivots 96 to the horizontal position in which they engage the slots 108 in the upper end 90 of the stationary walls 74 and 80, thus locking the access cover 92 in the closed position. A retaining pin or lock can then be inserted through aligned holes 100 in the fork tines 114 and alighned holes 102 in the radially extending arms 98 to restrain the radially extending arms in the locked position. A downwardly projecting lip 110 on the access cover 92 seats up against the outer upper surface of the movable sides 70 and 71 to lock the movable sides in the closed position when the access cover 92 is in place fully seated in the groove 94.

Figure 8:
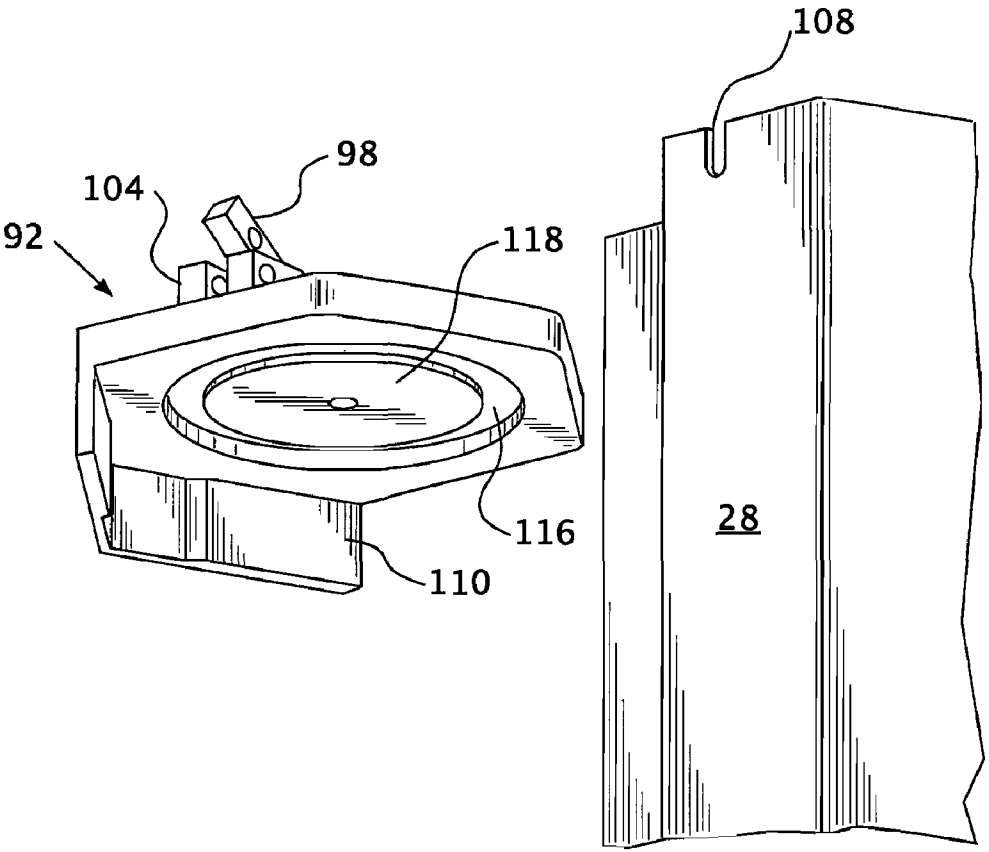
FIG. 8 is a perspective view showing the underside of the access cover to the tubular liner.

FIG. 8 shows another perspective view of the upper portion of the liner 28 with the access cover 92 in an open position showing the underside of the access cover. The underside of the access cover has a recess 116 in which the hold down plate 118 can be withdrawn as the access cover 92 is inserted into the annular groove 94 to close off the top of the tubular liner 28. A hole in the top of the access cover 106 (shown in FIG. 7) provides access to an adjustment screw that adjust the axial elevation of the hold down plate 118 so that it brings pressure against the top nozzle 4 of the fuel assembly 2 to restrain the fuel assembly in a secure position within the tubular liner 28.

Figure 9:
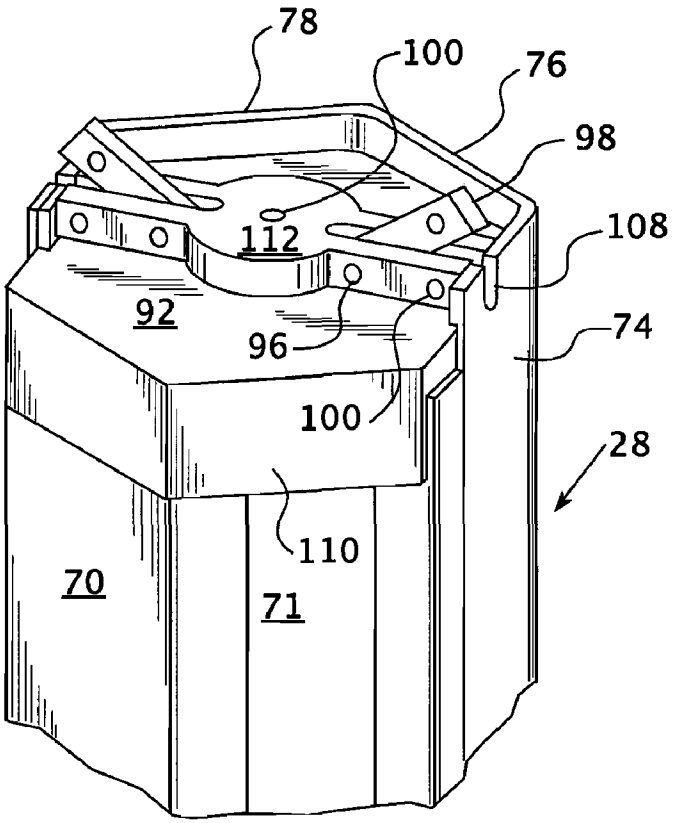
FIG. 9 is a perspective view of the top end of the tubular liner of this invention showing the access cover seated in a closed position with the locking mechanism shown open.

FIG. 9 shows the access cover 92 in the fully seated closed position locking the movable sides 70 and 71 in the closed position.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. A shipping container system for a first nuclear fuel product comprising:

an elongated tubular container having an axis extending along the container's elongated dimension, the container being designed to receive and support the first nuclear fuel product therein, an exterior of the tubular container having at least two substantially flat walls, with at least one circumferential end of at least one of the walls having a hinged interface with a stationary wall of the container to provide access to the interior thereof, the hinged wall extending axially in the direction of one end of the container and terminating a pre-selected distance short of the corresponding end of the stationary wall, the stationary wall having a lateral groove on an interior surface thereof extending in an orthogonal direction to the axis of the container at an elevation starting substantially at an elevation of the one end of the hinged wall, an access cover slidable in the groove in the stationary wall to close off the one end of the container so that the interior of the container may be accessed either through the one end by sliding out the access cover or from the side by rotating the hinged wall, the access cover having a means for locking the hinged wall in a closed position when the access cover is fully inserted in the groove and means for locking the access cover in a closed position to the stationary wall;

an elongated, tubular overpack having an axial dimension at least as long as the tubular container, an internal cross-section larger than the tubular container and an interior tubular channel having an axially extending lower support section supporting a plurality of shock mounts, with at least one of said plurality of shock mounts positioned on either radial side of the lower support section, the shock mounts support at least one of the flat walls of the tubular container in spaced relationship with the lower support section when the overpack is supported in a horizontal position, with at least one circumferential end of the lower support section having a clamped interface substantially along the axial dimension thereof to provide access to the interior of the overpack; and means for supporting the overpack in the horizontal position.

2. The shipping container system of claim 1 wherein the means for locking the access cover in a closed position is a pair of radially extending arms that pivot proximate one end on each of the radially extending arms that faces towards the center of the access cover, the pivot enabling a distal end of the radially extending arms to rotate upwardly from a position orthogonal to the axis of the elongated tubular container towards the axis, each of the radially extending arms extending at the distal end into a vertical slot in the stationary wall that extends axially to the one end of the stationary wall so that when the radially extending arm is rotated into a horizontal position and engages the slot in the stationary wall the access cover can not slide in the groove and when the radially extending arm is rotated towards the axis, out of engagement with the slot, the access cover can slide in the groove.

3. The shipping container system of claim 2 wherein the radially extending arms are laterally restrained in a slot in an outwardly projecting face of the access cover.

4. The shipping container system of claim 3 wherein the slot in the outwardly projecting face of the access cover is formed from a raised fork having two spaced prongs of a given width that form walls of the slot in the outwardly projecting face of the access cover.

5. The shipping container system of claim 4 wherein a hole is formed in the width of the wall of each prong that is aligned with a hole in the corresponding radially extending arm when the radially extending arm is rotated in the horizontal position to engage the slot in the stationary wall so that when a pin is inserted through the holes when the radially extending arm is in the horizontal position the radially extending arms are locked in engagement with the slot in the stationary wall.

6. The shipping container system of claim 1 wherein the means for locking the hinged wall comprises a lip on the access cover extending axially in the direction of the hinged wall over an outer surface of the hinged wall at the one end when the access cover is fully seated in the groove so as to prevent the hinged wall from rotating toward an open position.

7. The shipping container system of claim 1 having at least two hinged walls that interface at their non-hinged circumferential ends in a closed position with one of the non-hinged circumferential ends having an axially extending tongue and the other of the non-hinged circumferential ends having an axially extending groove that mates with the tongue when the at least two hinged walls are in the closed position.

8. The shipping container system of claim 1 wherein the stationary and hinged walls of the elongated tubular container are constructed from three extruded sections.

9. The shipping container system of claim 1 wherein the access cover includes a hold down plate supported and centered on an underside of the access cover, the hold down plate being adjustable in the axial direction to bring pressure on the first nuclear product to secure the first nuclear product against a bottom member of the elongated tubular container.

10. The shipping container system of claim 9 including a recess in the underside of the access cover in which the hold down plate can be withdrawn.

11. The shipping container system of claim 9 wherein an axial elevation of the hold down plate is adjusted from a top of the access cover.

12. The shipping container system of claim 1 wherein the access cover has a thickness substantially equal to the width of the groove in the stationary wall.

13. The shipping container system of claim 1 wherein the first nuclear fuel product comprises a fuel assembly having a hexagonal cross-section and the stationary walls and hinged walls of the tubular member are configured in a hexagon when in a closed position to closely match the contour of the fuel assembly.

14. The shipping container system of claim 1 wherein the hinged wall interface with the stationary wall is coupled by a single hinge pin.

15. An elongated tubular shipping container designed to receive and support a first nuclear fuel product therein, comprising:

an exterior of the tubular container having at least two substantially flat walls, with at least one circumferential end of at least one of the walls having a hinged interface with a stationary wall of the container to provide access to the interior thereof, the hinged wall extending axially in the direction of one end of the container and terminating a pre-selected distance short of the corresponding end of the stationary wall, the stationary wall having a lateral groove on an interior surface thereof at an elevation starting substantially at an elevation of the one end of the hinged wall;

an access cover slidable in the groove in the stationary wall to close off the one end of the container, the access cover having a means for locking the hinged wall in a closed position when the access cover is fully inserted in the groove and means for locking the access cover in a closed position to the stationary wall; and wherein the interior of the container may be accessed either through the one end by sliding out the access cover or from the side by rotating the hinged wall.

* * * * *